United States Patent [19]

Dienes

[11] Patent Number: 4,907,008

[45] Date of Patent: Mar. 6, 1990

[54] ANTENNA FOR TRANSMITTING CIRCULARLY POLARIZED TELEVISION SIGNALS

[75] Inventor: Geza Dienes, Claremont, Calif.

[73] Assignee: Andrew Corporation, Orland Park, Ill.

[21] Appl. No.: 176,631

[22] Filed: Apr. 1, 1988

[51] Int. Cl.[4] ..... H01Q 21/24

[52] U.S. Cl. ..... 343/727; 343/771; 343/799; 343/821; 343/890

[58] Field of Search ..... 343/725, 727, 770, 771, 343/768, 890, 891, 729, 730, 799, 821

[56] References Cited

U.S. PATENT DOCUMENTS

| | | | |
|---|---|---|---|
| 2,477,510 | 7/1949 | Chu . | |
| 2,562,332 | 7/1951 | Riblet . | |
| 2,635,188 | 4/1953 | Riblet . | |
| 2,658,143 | 3/1950 | Fiet/Scudder . | |
| 2,660,674 | 11/1953 | Brown . | |
| 2,724,774 | 11/1955 | Fiet . | |
| 2,803,008 | 8/1957 | Lindenblad . | |
| 2,947,988 | 8/1960 | Masters . | |
| 2,954,556 | 9/1960 | Yang . | |
| 2,971,193 | 2/1961 | Siukola . | |
| 2,981,944 | 4/1961 | Washburne . | |
| 2,981,947 | 4/1961 | Bazan . | |
| 3,005,984 | 10/1961 | Winter et al. . | |
| 3,106,713 | 10/1963 | Murata et al. . | |
| 3,193,830 | 7/1965 | Provencher . | |
| 3,218,644 | 11/1965 | Berry . | |
| 3,321,762 | 5/1967 | Zucconi . | |
| 3,340,534 | 9/1967 | Fee . | |
| 3,364,489 | 1/1968 | Masters . | |
| 3,524,189 | 8/1970 | Jones, Jr. . | |
| 3,581,311 | 5/1971 | Kach . | |
| 3,646,589 | 2/1972 | Poitevin . | |
| 3,870,977 | 3/1975 | Peoples et al. . | |
| 3,936,836 | 2/1976 | Wheeler et al. . | |
| 3,940,772 | 2/1976 | Ben-Dov . | |
| 3,987,454 | 10/1976 | Epis . | |
| 4,005,431 | 1/1977 | Hammarstrom . | |
| 4,011,567 | 3/1977 | Ben-Dov . | |
| 4,021,815 | 5/1977 | Bogner | 343/891 |
| 4,038,742 | 8/1977 | Kimball et al. . | |
| 4,119,970 | 10/1978 | Bogner et al. | 343/770 |
| 4,121,220 | 10/1978 | Scillieri et al. . | |
| 4,129,871 | 12/1978 | Johns | 343/727 |
| 4,129,872 | 12/1978 | Toman . | |
| 4,219,802 | 8/1980 | Ceseri . | |
| 4,247,858 | 1/1981 | Eichweber . | |
| 4,284,991 | 8/1981 | Dupressoir . | |
| 4,295,144 | 10/1981 | Matta et al. . | |
| 4,297,706 | 10/1981 | Nikolayuk . | |
| 4,297,707 | 10/1981 | Brunner et al. . | |
| 4,301,458 | 11/1981 | Johns . | |
| 4,369,447 | 1/1983 | Edney . | |
| 4,373,162 | 2/1983 | Peterson . | |
| 4,451,830 | 5/1984 | Lucas et al. . | |
| 4,583,098 | 4/1986 | Sikina | 343/771 |
| 4,590,480 | 5/1986 | Nikolayuk et al. . | |

OTHER PUBLICATIONS

A. Y. Hu & A. Ishimaru; "The Dominant Cutoff Wavelength of a Lunar Line"; Nov. 1961; IRE Transactions on Microwave Theory and Techniques.

A. Y. Hu & A. Ishimaru; "Attenuation Constant of Lunar Line and T-Septate Lunar Line"; Jul. 1963; IEEE Transactions on Microwave Theory and Techniques.

*Primary Examiner*—Rolf Hille

*Assistant Examiner*—Michael C. Wimer

*Attorney, Agent, or Firm*—Stephen G. Rudisill

[57] ABSTRACT

An antenna for circularly polarized television transmission comprising, an elongated coaxial waveguide having inner and outer conductors, the outer conductor of the waveguide having a multiplicity of slots spaced along the length and around the circumference of the outer conductor for radiating horizontally polarized energy, a multiplicity of dipoles mounted on the outer surface of the outer conductor and spaced along the length and around the circumference of the outer conductor for radiating vertically polarized energy, each of the dipoles being associated with one of the slots so that the combination of the horizontally and vertically polarized radiation produces circularly polarized radiation, and coupling means for coupling electromagnetic energy from the interior of the waveguide to the slots and the dipoles, the coupling means for both the slots and the dipoles picking up electromagnetic energy from the interior of the waveguide in a common transverse place.

17 Claims, 3 Drawing Sheets

ANTENNA FOR TRANSMITTING CIRCULARLY POLARIZED TELEVISION SIGNALS

FIELD OF THE INVENTION

The present invention relates generally to antennas for transmitting television signals with circular polarization.

BACKGROUND OF THE INVENTION

Antennas comprising coaxial waveguides having slotted outer conductors have been widely used to transmit television signals. In recent years it has become increasingly popular to transmit television signals with circular polarization, primarily to improve the reception of such signals in congested metropolitan areas. As is well known, a transmitting antenna can produce a circularly polarized wave by radiating separate vertically and horizontally polarized waves having the same amplitude with a 90° phase difference. Any departure from the equal amplitudes and/or the 90° phase difference produces an elliptically polarized wave, with the degree of ellipticity expressed as the "axial ratio", which is the ratio of the major axis to the minor axis of the ellipse.

SUMMARY OF THE INVENTION

It is a primary object of the present invention to provide an improved antenna for transmitting television signals with circular polarization, and which facilitates attainment of the desired axial ratio of the radiated field. In this connection, a related object of the invention is to provide such an antenna in which the coupling values and the phase and amplitude relationships of the orthogonally polarized radiating elements are independently variable. That is, the phase relationship between the orthogonally polarized radiated fields may be controlled without disturbing the amplitude relationship between those fields, and the coupling values of the radiating elements can be adjusted without degrading the axial ratio of the radiated field, i.e., without disturbing the desired phase and amplitude relationships between the orthogonally polarized waves radiated by the radiating elements.

A still further object of the invention is to provide such an improved antenna which can be used over a wide frequency band, e.g., for a number of different television channels, with only a few minor adjustments.

Other objects and advantages of the invention will become apparent upon reading the following detailed description and upon reference to the accompanying drawings.

DESCRIPTION OF THE PREFERRED EMBODIMENT

Figure 1:
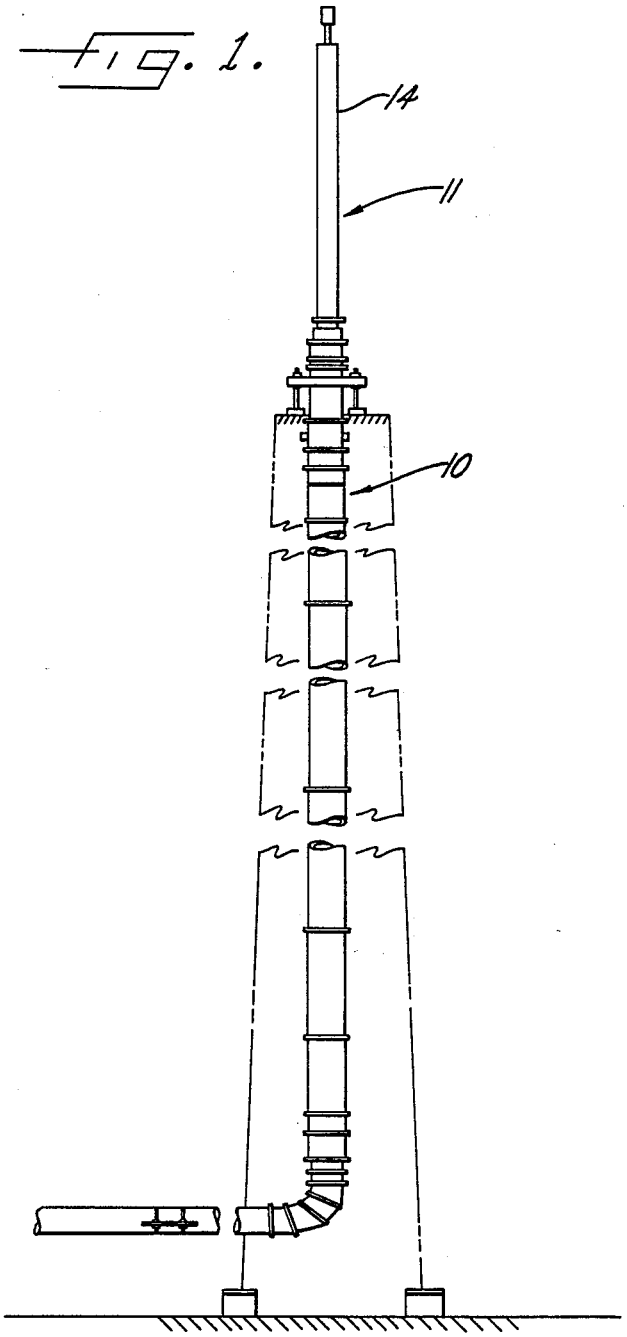
FIG. 1 is a side elevation of a television transmission system which includes an antenna embodying the present invention.

While the invention is susceptible to various modifications and alternative forms, a specific embodiment thereof has been shown by way of example in the drawings and will be described in detail. It should be understood, however, that it is not intended to limit the invention to the particular form disclosed, but, on the contrary, the intention is to cover all modifications, equivalents, and alternatives falling within the scope of the invention as defined by the appended claims.

Figure 2:
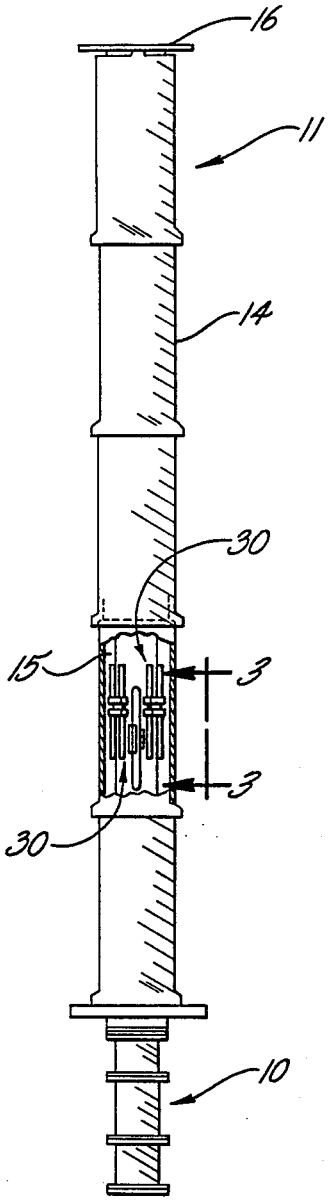
FIG. 2 is an enlarged side elevation of the antenna shown in FIG. 1, with a portion of the radome broken away to show the internal structure.

Referring now to FIG. 1, to transmit television signals, a waveguide coaxial-cable system 10 supplies input signals to an antenna 11 which is typically mounted on the top of a tower or tall building. The antenna 11 includes a vertical coaxial waveguide having inner and outer conductors 12 and 13 forming the main transmission line. To protect the electrical components of the antenna from the environment, the conductive portions are surrounded by a cylndrical radome 14 which is attached to a series of longitudinal ribs 15 on the outer surface of the conductor 13 (FIG. 2). The top of the antenna is closed by a plate 16 which forms a terminal short between the inner and outer conductors 12 and 13, thereby exciting a standing wave between the inner and outer conductors.

In order to radiate horizontally polarized waves corresponding to the signals fed to the antenna 11, the outer conductor 13 includes an array of vertically elongated radiating slots 19 which are spaced at 120° intervals around the circumference of the antenna and at approximately one-wavelength intervals (center-to-center) along the length of the antenna. The slots 19 are aligned with each other in both the longitudinal and circumferential directions. The length of each slot 19 in the direction of its major axis is preferably about one-half wavelength.

Figure 3:
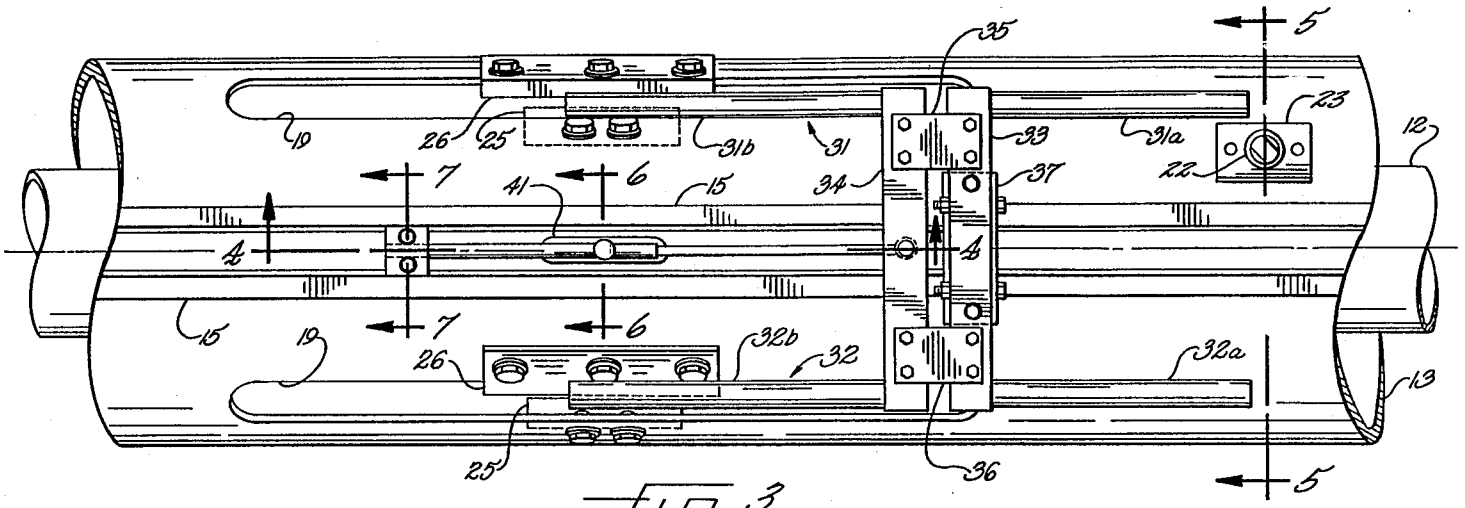
FIG. 3 is an enlarged section taken generally along line 3—3 in FIG. 2.
Figure 5:
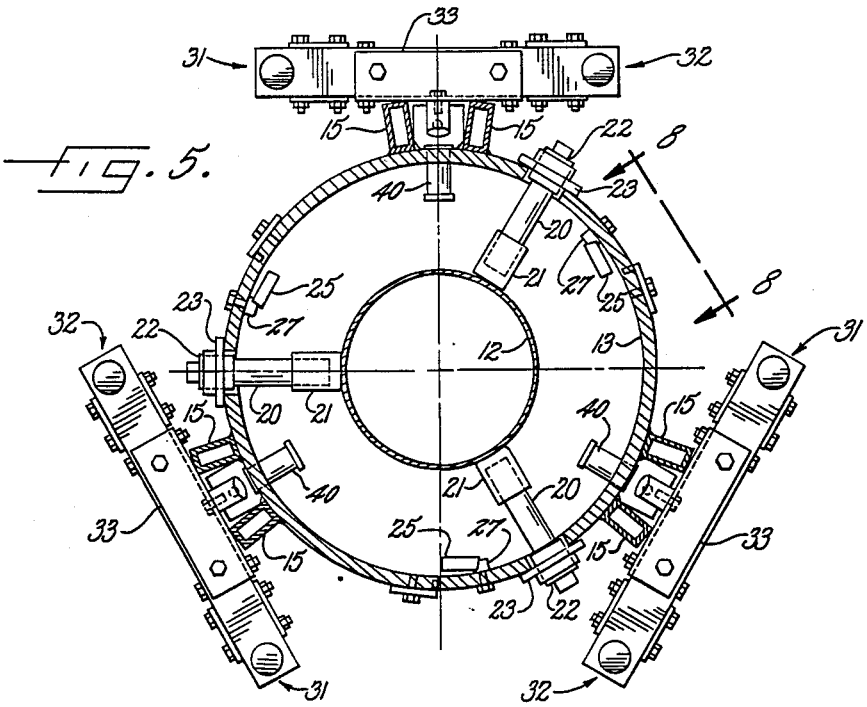
FIG. 5 is a section taken generally along line 5—5 in FIG. 3.
Figure 6:
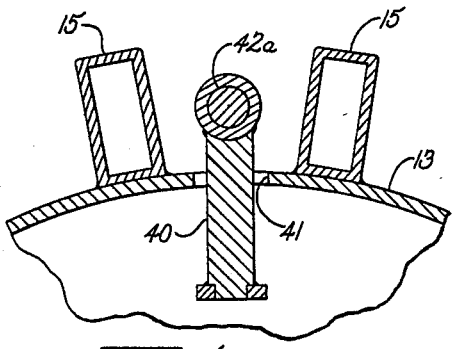
FIG. 6 is an enlarged section taken generally along line 6—6 in FIG. 3.
Figure 7:
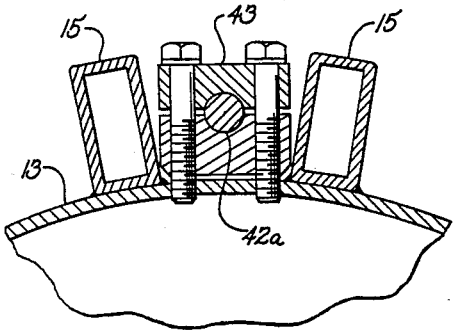
FIG. 7 is an enlarged section taken generally along line 7—7 in FIG. 3.

As illustrated in FIGS. 3 and 5, the inner and outer conductors 12 and 13 are held in a concentric relationship with each other by a plurality of support assemblies spaced at 120 degree intervals along the length of the waveguide. Each assembly includes a rod 20, a cap 21 engaging the outer surface of the inner conductor 12, and a fastener subassembly comprising collar 22 and plate 23.

Figure 8:
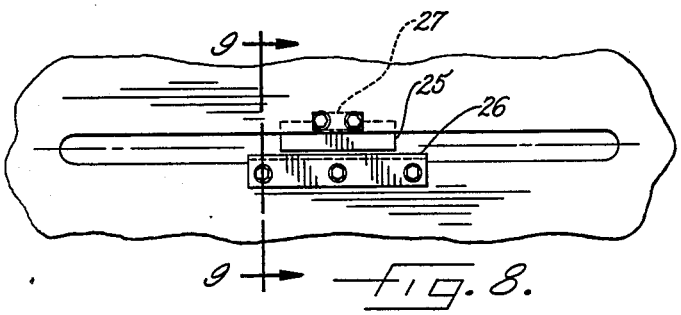
FIG. 8 is a fragmentary side elevation taken generally along line 8—8 in FIG. 5.
Figure 9:
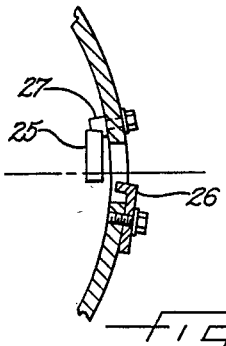
FIG. 9 is a section taken generally along line 9—9 in FIG. 8.

To feed electromagnetic energy from the coaxial waveguide to each of the elongated slots 19 for radiating horizontally polarized waves, a capacitive probe 25 is mounted on an L-shaped bracket 27 (FIGS. 8 and 9) and a trimming tab 26 attached to the outer conductor of the coaxial waveguide along one of the vertical edges of each slot 19 and the probe 25 extending through that slot 19 into the annular space between the inner and outer conductors. As is well known in the art of TV transmission antennas, this type of probe picks up energy from the coaxial waveguide and feeds it to the slot 19 from which the energy is radiated with horizontal polarization.

Vertically polarized waves corresponding to the signals fed to the antenna 11 are radiated by an array of vertically oriented dipole couplets 30 which are arranged in the same overall configuration as the slots 19 but offset therefrom in both the longitudinal and circumferential directions. Thus, the dipole couplets 30 are spaced at 120° intervals around the circumference of the outer conductor 13 of the coaxial waveguide, and at approximately one-wavelength intervals (center-to-center) along the length of the antenna. The couplets 30 are aligned with each other in both the longitudinal and circumferential directions, and the length of each couplet 30 is preferably about one-half wavelength.

As shown most clearly in FIG. 3, each of the dipole couplets 30 includes two parallel dipoles 31 and 32 extending parallel to the surface of the coaxial waveguide. The two dipoles 31 and 32 are connected to opposite ends of a twin lead transmision line formed by a pair of square aluminum tubes 33 and 34 attached to each other by a pair of insulating spacers 35 and 36. The tube 33 is rigidly attached to the outer surfaces of a pair of the longitudinal ribs 15 by means of an L-shaped aluminum bracket 37. A pair of bolts and nuts fasten the horizontal flange of the bracket 37 to the tube 33, and another pair of bolts and nuts fasten the vertical flange of the bracket 37 to the two ribs 15.

In FIG. 3, each dipole 31 and 32 comprises a pair of aluminum rods 31*a*, 31*b* and 32*a*, 32*b*. Rods 31*b* and 32*b* are welded to the tube 33 and rods 31*a* and 32*a* welded to the tube 33. As will be apparent from the ensuing description, the tube 34 is fed with electromagnetic energy from the coaxial waveguide; thus, the dipole rods 31*a* and 32*a* welded to the tube 34 are the "fed" ends of the dipoles. The dipole rods 31*a* and 32*a* welded to the tube 33 are the "grounded" ends of the dipoles because the tube 33 is connected to the ribs 15 on the outer conductor of the coaxial waveguide.

Figure 4:
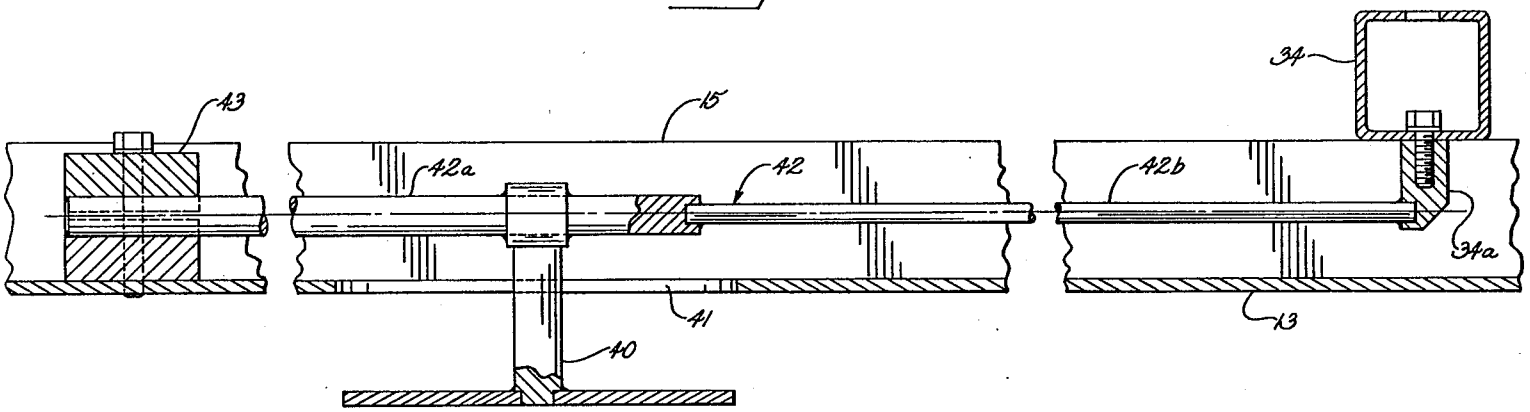
FIG. 4 is an enlarged section taken generally along line 4—4 in FIG. 3.

Referring now to FIGS. 3 and 4, to feed electromagnetic energy from the coaxial waveguide to each dipole couplet, the pair of longitudinal ribs 15 on which each couplet is mounted are used as part of a trough transmission line to transmit energy from a probe 40 to the tube 34. The probe 40 is a capacitive probe which extends into the annular space between the inner and outer conductors of the coaxial waveguide. Access for the probe 40 is provided by a small slot 41 formed in the outer conductor 13 at a location between the two ribs 15 which carry the dipole couplet to be fed by that particular probe. The probe slot 41 is circumferentially aligned with one set of the larger radiation slots 19.

In FIG. 4 to complete the trough transmission line, an aluminum rod 42 is connected at one end to the tube 34 and at the other end to a shorting block 43, with the probe 40 being connected to the rod 42 at an intermediate location between the tube 34 and the shorting block 43. The rod 42 thus forms the inner conductor of the trough transmission line. (In the particular embodiment illustrated, the rod 42 is formed from two parts, a thicker rod 42*a* attached to the probe 30 and the shorting block 43, and a thinner rod 42*b* attached to a depending stub 34*a* from the tube 34 and the rod 42*a*.) The distance from the probe 40 to the shorting block 43 is preferably about a quarter wavelength, while the distance from the probe 40 to the tube 34 is selected (or adjusted empirically) to provide the desired phase relationship between the horizontally polarized radiation from the slots 19 and the vertically polarized radiation from the dipole couplets 30. Because the rails 15 extend continuously along the length of the coaxial waveguide, the longitudinal position of the dipole couplet 30, and thus the phase relationship of the orthogonally polarized radiations, can be easily adjusted. The amplitude of the vertically polarized radiation from the dipole couplet is determined by the depth of penetration of the probe 40 into the coaxial waveguide.

I claim:

1. An antenna for circularly polarized television transmission comprising, an elongated coaxial waveguide having inner and outer conductors, the outer conductor of said waveguide having a multiplicity of slots spaced along the length and around the circumference of the outer conductor for radiating horizontally polarized energy, a multiplicity of dipoles mounted on the outer surface of said outer conductor and spaced along the length and around the circumference of the outer conductor for radiating vertically polarized energy, each of said dipoles being disposed in relation to said slots so that the combination of the horizontally and vertically polarized radiation produces circularly polarized radiation, and first coupling means and second coupling means for respectively coupling electromagnetic energy from the interior of said waveguide to said slots and to said dipoles, each of said coupling means being separate and independent from each other, and disposed at least partially within said waveguide and picking up electromagnetic energy between the inner and outer conductors of said waveguide in a common transverse plane.

2. The antenna of claim 1 wherein said second coupling means for said dipoles includes an external transmission line on the exterior of said waveguide.

3. The antenna of claim 1 wherein said first coupling means includes means associated with each of said slots for feeding electromagnetic energy directly from the interior of said waveguide to said slots, and said second coupling means includes an internal probe and an external transmission line associated with each of said dipoles for feeding electromagnetic energy from the interior of said waveguide to said dipoles.

4. The antenna of claim 3 wherein said external transmission line is a through line mounted on the exterior surface of said outer conductor.

5. The antenna of claim 1 wherein each of said dipoles has a first end connected to said second coupling means and a second end connected to said outer conductor.

6. The antenna of claim 1 wherein said second coupling means includes a plurality of probes extending into said waveguide at intervals along the length thereof, and a trough transmission line formed by a pair of longitudinal ribs on the exterior surface of said outer conductor and a plurality of external conductors disposed between said ribs, each of said external conductors connecting one of said probes to one of said dipoles.

7. The antenna of claim 1 wherein each of said dipoles comprises double dipoles connected by a twin lead transmission line.

8. The antenna of claim 7 wherein said dipoles are mounted on said twin lead transmission line which in turn is mounted on a pair of longitudinal ribs on the exterior surface of said outer conductor.

9. The antenna of claim 8 wherein said longitudinal ribs form part of a trough transmission line for feeding electromagnetic energy to said dipoles.

10. The antenna of claim 1 wherein said second coupling means comprises an internal probe and an external transmission line for coupling energy to said dipoles.

11. The antenna of claim 1 wherein said multiplicity of dipoles includes means for adjusting the phase relationship of the said horizontally and vertically polarized radiations.

12. The antenna of claim 1 wherein said second coupling means includes means for adjusting the amplitude of the vertically polarized radiation.

13. Antenna of claim 1 wherein said multiplicity of dipoles includes means for adjusting the phase relationship of the said horizontally and vertically polarized radiations independent from means within the second coupling means for adjusting the amplitude of the vertically polarized radiation.

14. An antenna for circularly polarized television transmission comprising, an elongated coaxial waveguide having inner and outer conductors, the outer conductor of said waveguide having a multiplicity of slots spaced along the length and around the circumference of the outer conductor for radiating horizontally polarized energy, a multiplicity of dipoles mounted on the outer surface of said outer conductor and spaced along the length and around the circumference of the outer conductor for radiating vertically polarized energy, each of said dipoles being disposed in relation to said slots so that the combination of the horizontally and vertically polarized radiation produces circularly polarized radiation, first coupling means for coupling electromagnetic energy from the interior of said waveguide to said slots and including means for feeding electromagnetic energy directly from the interior of said waveguide to said slots, and second coupling means for coupling electromagnetic energy from the interior of said waveguide to said dipoles independently of said first coupling means and including an internal probe and an external transmission line associated with each of said dipoles for feeding electromagnetic energy from the interior of said waveguide to said dipoles.

15. An antenna for circularly polarized television transmission comprising, an elongated coaxial waveguide having inner and outer conductors, the outer conductor of said waveguide having a multiplicity of slots spaced along the length and around the circumference of the outer conductor for radiating horizontally polarized energy, a multiplicity of dipoles mounted on the outer surface of said outer conductor and spaced along the length and around the circumference of the outer conductor for radiating vertically polarized energy, each of said dipoles being disposed in relation to said slots so that the combination of the horizontally and vertically polarized radiation produces circularly polarized radiation, and first coupling means for coupling electromagnetic energy from the interior of said waveguide to said slots, and second coupling means for coupling electromagnetic energy from the interior of said waveguide to said dipoles and including: a plurality of probes extending into said waveguides at intervals along the length thereof, a trough transmission line formed by a pair of longitudinal ribs on the exterior surface of said outer conductor, and a plurality of external conductors, disposed between said ribs, for respectively connecting one of said probes to one of said dipoles.

16. The antenna of claim 15 wherein said multiplicity of dipoles includes means for adjusting the phase relationship of the polarized radiations independent from means within said second coupling means for adjusting the amplitude of the vertically polarized radiation.

17. An antenna for circularly polarized television transmission comprising, an elongated coaxial waveguide having inner and outer conductors, the outer conductor of said waveguide having a multiplicity of slots spaced along the length and around the circumference of the outer conductor for radiating horizontally polarized energy, a multiplicity of dipoles mounted on the outer surface of said outer conductor and spaced along the length and around the circumference of the outer conductor for radiating vertically polarized energy, each of said dipoles being disposed in relation to said slots so that the combination of the horizontally and vertically polarized radiation produces circularly polarized radiation, and first coupling means for coupling electromagnetic energy to said slots, and second coupling means for coupling electromagnetic energy to said dipoles and being separate and independent of said first coupling means, each of said coupling means being at least partially disposed within said waveguide and picking up electromagnetic energy from the interior of said waveguide in a common transverse plane.

* * * * *